US009212646B2

(12) United States Patent
Tanaya

(10) Patent No.: US 9,212,646 B2
(45) Date of Patent: Dec. 15, 2015

(54) IGNITION APPARATUS

(75) Inventor: Kimihiko Tanaya, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 777 days.

(21) Appl. No.: 13/493,568

(22) Filed: Jun. 11, 2012

(65) Prior Publication Data

US 2013/0192571 A1 Aug. 1, 2013

(30) Foreign Application Priority Data

Jan. 27, 2012 (JP) ..... 2012-014776

(51) Int. Cl.

| | |
|---|---|
| ***H01F 38/12*** | (2006.01) |
| ***F02P 3/00*** | (2006.01) |
| ***F02P 3/04*** | (2006.01) |
| ***F02P 9/00*** | (2006.01) |
| ***F02P 15/10*** | (2006.01) |

(52) U.S. Cl.

CPC ..... *F02P 3/005* (2013.01); *F02P 3/0407* (2013.01); *F02P 9/007* (2013.01); *F02P 15/10* (2013.01)

(58) Field of Classification Search

CPC ..... F02P 3/0838; F02P 3/0884; F02P 9/002; F02P 9/007; F02P 1/086

USPC ..... 123/605, 621, 620, 622, 634, 640, 618, 123/641, 650, 651, 654, 594, 595, 596, 597, 123/598, 606, 607

See application file for complete search history.

(56) References Cited

U.S. PATENT DOCUMENTS

| | | | | |
|---|---|---|---|---|
| 3,488,556 | A * | 1/1970 | Burley | 315/60 |
| 3,871,349 | A * | 3/1975 | Hager | 123/169 EL |
| 4,029,990 | A * | 6/1977 | Nagy et al. | 315/62 |
| 4,733,646 | A | 3/1988 | Iwasaki | |
| 2002/0170547 | A1 * | 11/2002 | Lepley | 123/604 |
| 2007/0062501 | A1 * | 3/2007 | Ishida | 123/618 |
| 2010/0206277 | A1 * | 8/2010 | Kajita | 123/620 |

FOREIGN PATENT DOCUMENTS

| | | |
|---|---|---|
| JP | 53-126439 | 11/1978 |
| JP | 63-036062 A | 2/1988 |
| JP | 04-303179 A | 10/1992 |
| JP | 2000-240542 A | 9/2000 |
| JP | 2010-096128 A | 4/2010 |
| JP | 2010-151069 A | 7/2010 |

OTHER PUBLICATIONS

Japanese Office Action in Japanese Application No. 2012-014776 dated Jan. 22, 2013.

* cited by examiner

*Primary Examiner* — Hai Huynh
*Assistant Examiner* — Raza Najmuddin
(74) *Attorney, Agent, or Firm* — Sughrue Mion, PLLC

(57) ABSTRACT

There are provided a first coil device (102) that releases accumulated energy so as to generate a predetermined high voltage and supplies the predetermined high voltage to a first electrode (101*a*) of an ignition plug (101) so that a spark discharge path is formed in a gap between the first electrode (101*a*) and a second electrode (101*b*), and a second coil device (103, 301) that supplies a current to the spark discharge path formed in the gap by releasing accumulated energy; a large AC discharge current is supplied in a short cycle to the gap between the electrodes of the ignition plug (101).

9 Claims, 3 Drawing Sheets

IGNITION APPARATUS

BACKGROUND OF THE INVENTION

1. Field of the Invention

The present invention relates to an ignition apparatus that is utilized mainly in an internal combustion engine.

2. Description of the Related Art

In recent years, the issues such as environment preservation and fuel depletion have been raised; measures for these issues are urgently required also in the automobile industry. The measures include, as an example, ultra-lean-combustion (referred to also as stratified-lean-combustion) operation of an internal combustion engine that utilizes a stratified air-fuel mixture. In the stratified lean combustion, the distribution of inflammable fuel-air mixtures may vary; therefore, an ignition apparatus capable of absorbing this variation is required.

A conventional ignition apparatus disclosed in Patent Document 1 is provided with an ignition plug that produces a spark discharge in a combustion chamber and a microwave generation apparatus that supplies energy to the spark discharge produced in the ignition plug. It is alleged that because the conventional ignition apparatus makes it possible to form larger discharge plasma, a great number of spatial igniting opportunities can be provided, the variation in the distribution of fuel-air mixtures can be absorbed, and the foregoing requirement on stratified lean combustion is satisfied.

PRIOR ART REFERENCE

Patent Document

[Patent Document 1] Japanese Patent Application Laid-Open No. 2010-96128

The conventional ignition apparatus disclosed in Patent Document 1 can prevent extinction and can suppress the variation in the torque to be produced because it can form large discharge plasma; however, because a path for introducing a microwave is required in addition to an ignition plug, it is difficult to apply the ignition apparatus disclosed in Patent Document 1 to an existing engine. There has been a problem that in terms of matching in impedance, technology, and product, it is very difficult to stably supply high-frequency energy such as a microwave into an extremely unstable combustion chamber in which a piston reciprocates, a large pressure change is recurrently caused, and production and extinction of plasma are repeated through discharge and combustion.

SUMMARY OF THE INVENTION

The present invention has been implemented in order to solve the foregoing problems in those conventional systems; the objective thereof is to provide an ignition apparatus that is simply configured and is capable of forming large discharge plasma.

An ignition apparatus according to the present invention is characterized by including an ignition plug that is provided with a first electrode and a second electrode facing each other through a gap and produces a spark discharge in the gap so that an inflammable fuel-air mixture inside a combustion chamber of an internal combustion engine is ignited; a first coil device that generates a predetermined high voltage and supplies the generated predetermined high voltage to the first electrode so as to form a path of the spark discharge in the gap; and a second coil device that supplies a current to the spark discharge path formed in the gap.

In an ignition apparatus according to the present invention, because a large AC current can be supplied in a short cycle into the space between the electrodes of the ignition plug, it is made possible that large discharge plasma can be produced with a simple configuration and hence lean combustion can stably be implemented; therefore, the fuel utilized for the operation of an internal combustion engine can drastically be reduced, whereby the carbon footprint can largely be decreased and hence the ignition apparatus can contribute to the environment preservation.

The foregoing and other object, features, aspects, and advantages of the present invention will become more apparent from the following detailed description of the present invention when taken in conjunction with the accompanying drawings.

DETAILED DESCRIPTION OF THE PREFERRED EMBODIMENTS

Embodiment 1

Figure 1:
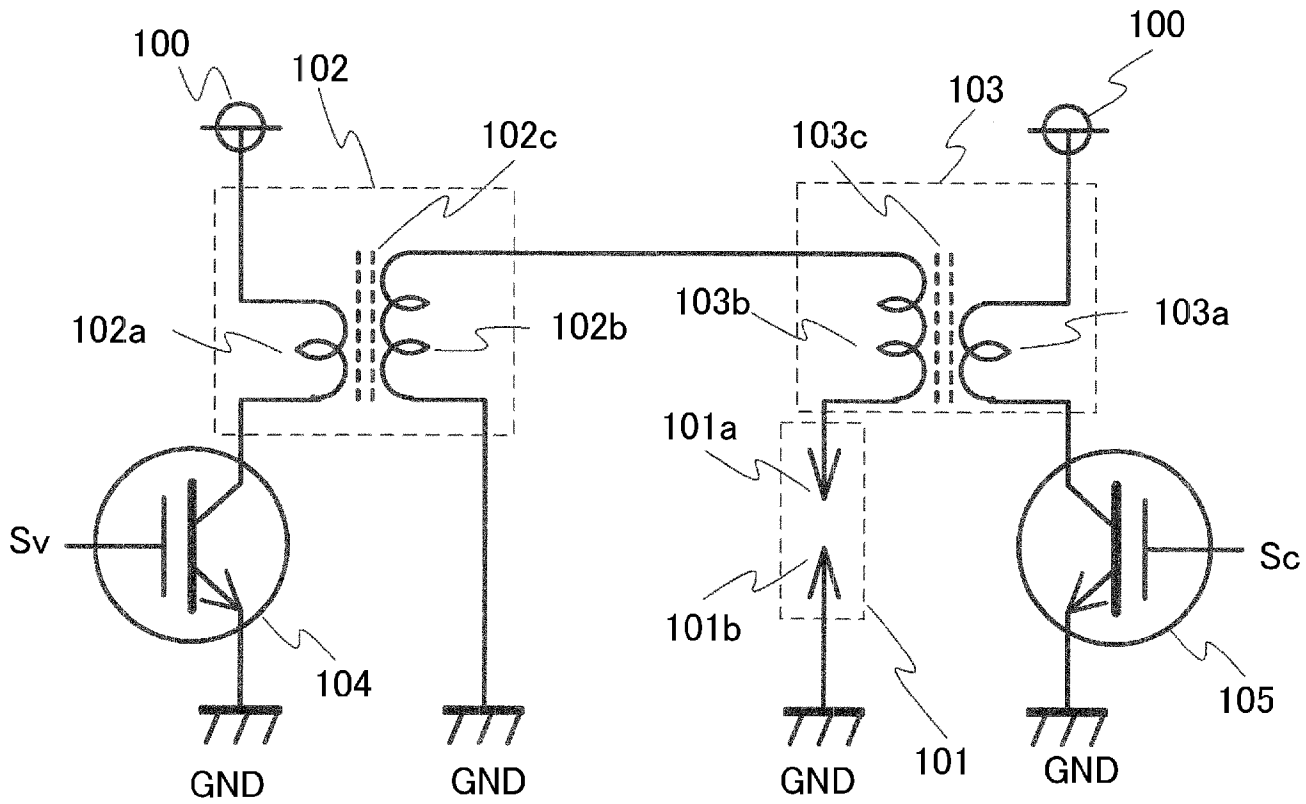
FIG. 1 is a configuration diagram of an ignition apparatus according to Embodiment 1 of the present invention.

FIG. 1 is a configuration diagram of an ignition apparatus according to Embodiment 1 of the present invention. In FIG. 1, an ignition apparatus according to Embodiment 1 of the present invention is provided with an ignition plug 101 having a central electrode 101*a*, as a first electrode, and a GND electrode 101*b*, as a second electrode, which face each other through a plug gap, which is a predetermined gap; a high-voltage supply coil 102, as a first coil device, having a primary coil 102*a* and a secondary coil 102*b* that are magnetically coupled with each other through an iron core 102*c*; a current supply coil 103, as a second coil device, having a primary coil 103*a* and a secondary coil 103*b* that are magnetically coupled with each other through an iron core 103*c*; a first switching device 104 connected in series with the primary coil 102*a* of the high-voltage supply coil 102; and a second switching device 105 connected in series with the primary coil 103*a* of the current supply coil 103. In Embodiment 1, each of the first switching device 104 and the second switching device 105 is formed of an IGBT, which is a transistor device.

The secondary coil 102*b* of the high-voltage supply coil 102 and the secondary coil 103*b* of the current supply coil 103 are connected in series with each other through the ignition plug 101 and the ground potential (referred to as GND, hereinafter) of a vehicle. The ignition plug 101 is disposed in a combustion chamber of the engine. The high-voltage supply coil 102 supplies a predetermined high voltage to the central electrode 101*a* of the ignition plug 101, causes a dielectric breakdown in the plug gap between the central electrode 101*a* and the GND electrode 101*b*, and forms a spark discharge path in the plug gap. The current supply coil 103 supplies, as described later, a large current into the foregoing spark discharge path formed in the plug gap of the ignition plug 101.

The current supply coil 103 cannot solely produce such a high voltage as causes a dielectric breakdown in the plug gap of the ignition plug 101; however, the current supply coil 103 can make an extremely large induction current of, for example, approximately 1 [A] through 10 [A] flow. In general, an ignition plug incorporates a resistance body of approximately 5 [kΩ]; because as described above, an induction current of approximately several amperes is made to flow in the ignition plug 101, large energy is wasted through heating when the resistance component of the current path is large. Accordingly, it is desirable to select an ignition plug having a small resistance value of, for example, 300[Ω] or smaller for the current path, excluding the inter-electrode gap, of the ignition plug 101.

The first switching device 104 is switching-controlled based on a control signal Sv from an engine control unit (unillustrated and referred to as an ECU, hereinafter) so as to control the primary current that flows from a power source 100 to the primary coil 102*a* of the high-voltage supply coil 102, so that a predetermined high voltage is generated across the secondary coil 102*b*. The second switching device 105 is switching-controlled based on a control signal Sc from the engine control unit (ECU) so as to control the primary current that flows from the power source 100 to the primary coil 103*a* of the current supply coil 103, so that a predetermined induction current is generated in the secondary coil 103*b*.

Figure 2:
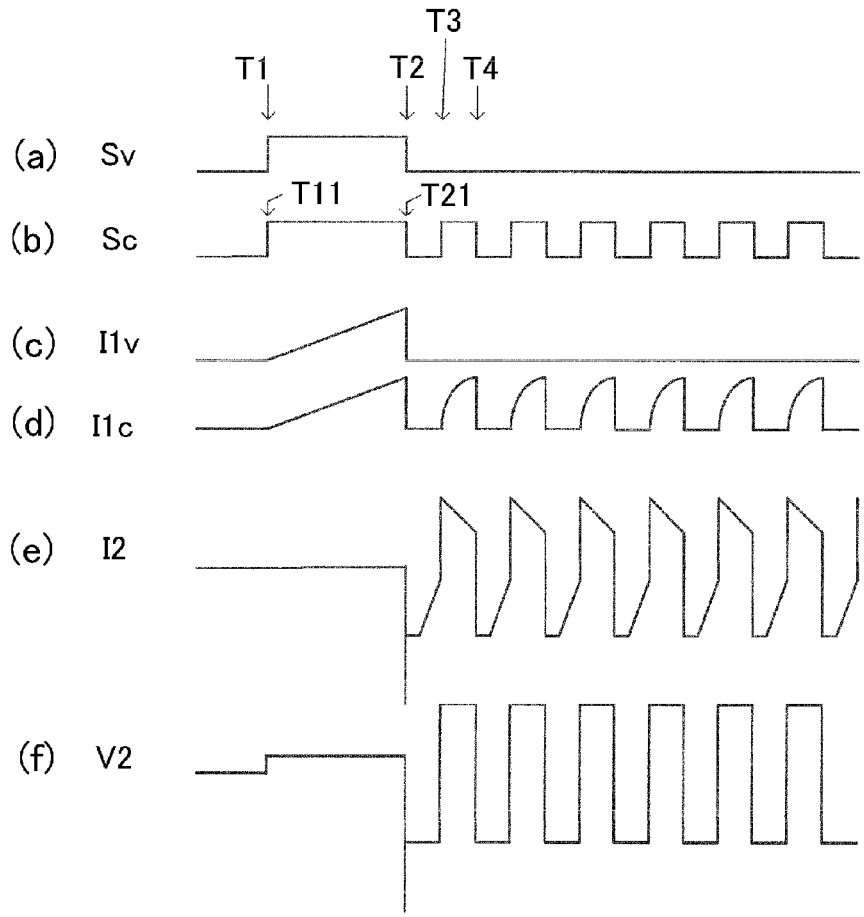
FIG. 2 is a timing chart for explaining the operation of an ignition apparatus according to Embodiment 1 of the present invention.

Next, there will be explained the operation of the ignition apparatus, according to Embodiment 1 of the present invention, that is configured as described above. FIG. 2 is a timing chart for explaining the operation of the ignition apparatus according to Embodiment 1 of the present invention; FIG. 2(*a*) represents the waveform of the control signal Sv supplied to the base of the first switching device 104; FIG. 2(*b*) represents the waveform of the control signal Sc supplied to the base of the second switching device 105; FIG. 2(*c*) represents a primary current I1*v* that flows in the primary coil 102*a* of the high-voltage supply coil 102; FIG. 2(*d*) represents a primary current I1*c* that flows in the primary coil 103*a* of the current supply coil 103; FIG. 2(*e*) represents a secondary current I2 that is an induction current induced in the secondary coil 103*b* of the current supply coil 103; and FIG. 2(*f*) represents a secondary voltage V2 that is an induction voltage induced across the secondary coil 103*b* of the current supply coil 103.

In FIGS. 1 and 2, at first, when at the timing T1, the control signal Sv for controlling the first switching device 104 becomes high-level (referred to H-level, hereinafter), the first switching device 104 turns on; then, the primary current I1*v* flows from the power source 100 to the GND, by way of the primary coil 102*a* of the high-voltage supply coil 102 and the first switching device 104. Due to the primary current I1*v* that flows in the primary coil 102*a*, the high-voltage supply coil 102 accumulates magnetic energy.

At the timing T2 after sufficient magnetic energy has been accumulated in the high-voltage supply coil 102, the control signal Sv turns to be low-level (referred to as L-level, hereinafter). As a result, the first switching device 104 turns off, whereby the primary current I1*v* flowing in the high-voltage supply coil 102 is cut off. As a result, the high-voltage supply coil 102 releases the accumulated magnetic energy, so that a secondary voltage, which is a predetermined high voltage, is generated across the secondary coil 102*b*.

The secondary voltage generated across the secondary coil 102*b* of the high-voltage supply coil 102 is applied to the central electrode 101*a* of the ignition plug 101 by way of the secondary coil 103*b* of the current supply coil 103. As a result, at the timing T2, a dielectric breakdown is caused in the plug gap between the central electrode 101*a* and the GND electrode 101*b*, whereby a spark discharge path is formed.

On the other hand, when at the timing T11, the control signal Sc becomes H-level, the second switching device 105 turns on; then, the primary current I1*c* flows from the power source 100 to the GND, by way of the primary coil 103*a* of the current supply coil 103, and the collector and the emitter of the second switching device 105. Here, the timing T11 may be either the same as or different from the timing T1.

When at the timing T11, application of the primary current I1*c* to the primary coil 103*a* of the current supply coil 103 starts, a secondary voltage V2 is induced across the secondary coil 103*b*, as represented in FIG. 2(*f*), and the secondary voltage V2 is applied to the central electrode 101*a* of the ignition plug 101; however, because no dielectric breakdown is caused in the plug gap by this level of voltage, no secondary current I2 flows in the plug gap, as represented in FIG. 2(*e*). Due to the primary current I1*c* that starts to flow in the primary coil 103*a* from the timing T11, the current supply coil 103 accumulates magnetic energy.

At the timing T21 after sufficient magnetic energy has been accumulated in the current supply coil 103, the control signal Sc is turned to be L-level, so that the primary current I1*c* is cut off. Here, it is desirable to set the timing T21 in a time period in which a discharging path is being formed in the plug gap. In other words, the timing T21 may be either the same as the timing T2 or behind the timing T2 by approximately 0 to 100 [μs]. If the timing T21 precedes the timing T2, the magnetic energy accumulated in the current supply coil 103 is released while no discharging path is formed in the plug gap; therefore, because no dielectric breakdown can be caused in the plug gap and hence no induction current can be supplied, the magnetic energy that has been accumulated from the timing T11 is wastefully released; thus, it is not efficient.

At the timing T21, the current supply coil 103 releases the accumulated magnetic energy. Because as described above, a discharging path has already been formed in the plug gap at the timing T2 and hence the impedance has become extremely small, even the current supply coil 103 having a low capability for supplying voltage can efficiently make the secondary current I2, which is an induction current, flow into the discharging path.

Next, when at the timing T3, the level of the control signal Sc is changed to H level, the primary current I1*c* starts to flow again in the primary coil 103*b* of the current supply coil 103, and magnetic energy is accumulated in the current supply coil 103; concurrently, across the secondary coil 103*b*, there is induced a secondary voltage V2 having a polarity contrary to that thereof at a time when the magnetic energy is released.

In addition, in Embodiment 1, the direction from the central electrode 101*a* of the ignition plug 101 to the GND electrode 101*b* will be referred to as the positive direction. Thus, when magnetic energy is released, each of the high-voltage supply coil 102 and the current supply coil 103 generates a negative voltage, and the secondary current I2 having the negative direction flows; when the primary current Ic1 flows, the secondary voltage V2, which is a positive voltage, is induced and the secondary current I2 having the positive direction flows.

At the timing T3, because the discharging path has been formed, the impedance in the plug gap is low; due to a positive voltage generated across the secondary coil 103*b* of the current supply coil 103, a positive-direction discharge current I2, the direction of which is contrary to the direction of the discharge current I2 that has been flowing so far, flows in the plug gap.

Next, when at the timing T4, the level of the control signal Sc is turned to the L level, the primary current I1*c* of the current supply coil 103 is cut off and hence the current supply coil 103 releases the accumulated energy; thus, the secondary current I2 having the negative direction flows in the plug gap.

After that, by repeating operation similar to the operation from the timing T3 to the timing T4, the secondary current I2 that has the positive direction and the negative direction alternately, i.e., that is an AC large current can be made to flow into the plug gap; therefore, a great deal of plasma can be produced in the plug gap.

As described above, in the ignition apparatus according to Embodiment 1 of the present invention, a large AC current can be supplied in a short cycle into the space between the electrodes of the ignition plug; therefore, it is made possible that large discharge plasma can readily be produced with a simple configuration and hence lean combustion can stably be implemented. As a result, because the fuel utilized for the operation of an internal combustion engine can drastically be reduced, the carbon footprint can largely be decreased, whereby the ignition apparatus can contribute to the environment preservation.

In the ignition apparatus according to Embodiment 1 of the present invention, the current supply coil is driven through a so-called full-transistor ignition method in which a current supply coil is driven by an IGBT second switching device, which is a transistor device; therefore, a simple and inexpensive ignition apparatus can be obtained. The full-transistor ignition method makes it possible to supply a large current in a cycle of as short as 1 [MHz] and repeatedly in a short time to the space between the electrodes of an ignition plug; thus, large discharge plasma can be formed in the ignition plug.

Embodiment 2

For the purpose of forming large discharge plasma and supplying a great deal of plasma into a large area of the combustion chamber of an internal combustion engine, it is desirable to apply "a large current" to the plug gap "repeatedly in a short time". In foregoing Embodiment 1, for the purpose of applying "a large current" to the plug gap "repeatedly in a short time", the current supply coil is driven through the full-transistor ignition method.

However, in terms of supplying "a large current", it is desirable to drive the current supply coil through a capacitive-discharge ignition method (referred to as a "CDI method", hereinafter) In this regard, however, although being capable of supplying a large current, a common CDI method has a difficulty in supplying a large current "repeatedly in a short time", because charging of a capacitor, which is the supply source of a capacitive current, requires a time of approximately several seconds.

An ignition apparatus according to Embodiment 2 of the present invention is configured in such a way that a current supply coil is driven through a CDI method configured as described later, so that "a large current" can be supplied "repeatedly in a short time".

Figure 3:
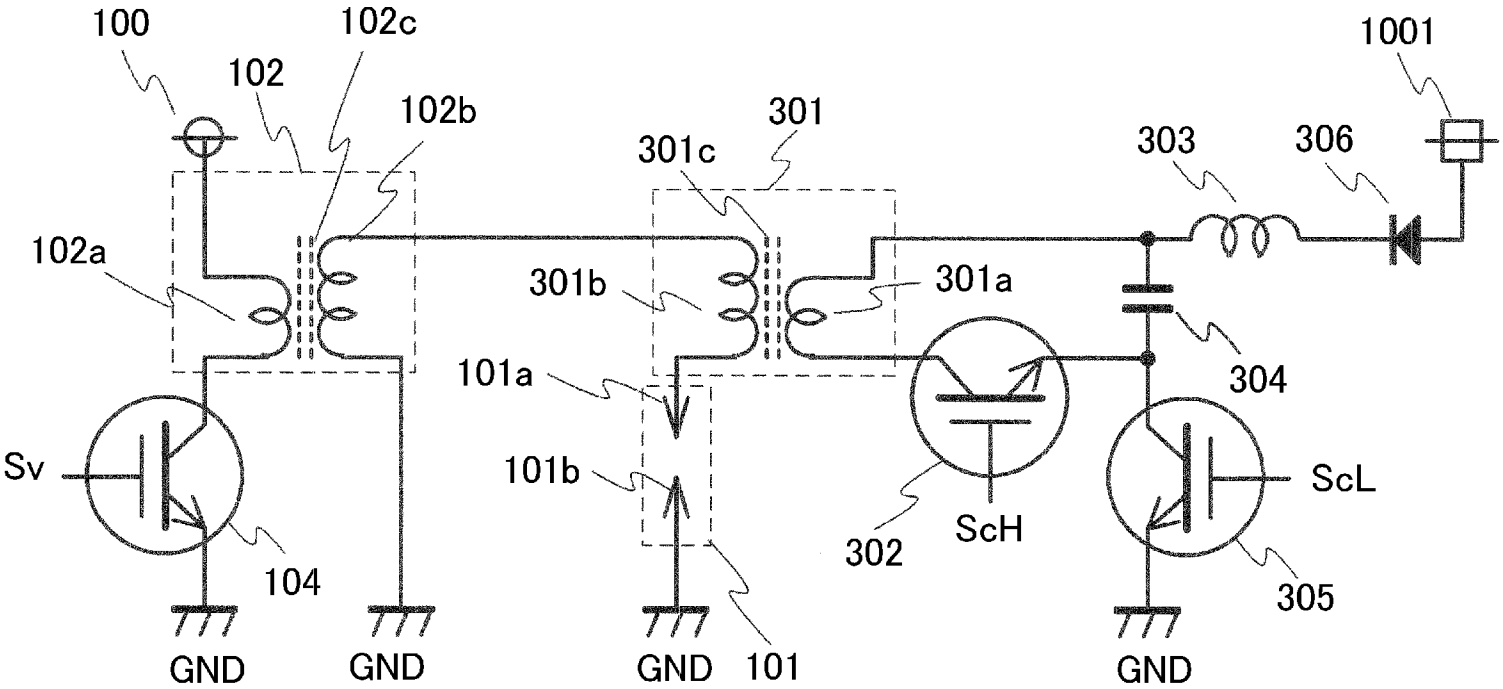
FIG. 3 is a configuration diagram of an ignition apparatus according to Embodiment 2 of the present invention.

FIG. 3 is a configuration diagram of an ignition apparatus according to Embodiment 2 of the present invention. In FIG. 3, an ignition apparatus according to Embodiment 2 of the present invention is provided with an ignition plug 101 having a central electrode 101*a*, as a first electrode, and a GND electrode 101*b*, as a second electrode, which face each other through a predetermined plug gap; a high-voltage supply coil 102, as a first coil device, having a primary coil 102*a* and a secondary coil 102*b* that are magnetically coupled with each other through an iron core 102*c*; a current supply coil 301, as a second coil device, having a primary coil 301*a* and a secondary coil 301*b* that are magnetically coupled with each other through an iron core 301*c*; a first switching device 104 connected in series with the primary coil 102*a* of the high-voltage supply coil 102; a second switching device 302 connected in series with the primary coil 301*a* of the current supply coil 301; an ignition capacitor 304 connected across the secondary coil 301*a* by way of the second switching device 302; a third switching device 305 connected between the connecting point of the emitter of the second switching device 302 and the ignition capacitor 304; and a rectifier diode 306 and an inductor 303 that are connected between a power source 1001 and the ignition capacitor 304.

The ignition capacitor 304 and the inductor 303 configure an LC resonance circuit; as described later, the ignition capacitor 304 is charged based on a resonance phenomenon of the LC resonance circuit.

In Embodiment 2, each of the first switching device 104, the second switching device 302, and the third switching device 305 is formed of an IGBT, which is a transistor device.

The secondary coil 102*b* of the high-voltage supply coil 102 and the secondary coil 301*b* of the current supply coil 301 are connected in series with each other through the ignition plug 101 and the GND of a vehicle. The ignition plug 101 is disposed in a combustion chamber of the engine. The high-voltage supply coil 102 supplies a predetermined high voltage to the central electrode 101*a* of the ignition plug 101, causes a dielectric breakdown in the plug gap between the central electrode 101*a* and the GND electrode 101*b*, and forms a spark discharge path in the plug gap. The current supply coil 301 supplies, as described later, a large current into the spark discharge path formed in the plug gap of the ignition plug 101.

As described above, the ignition capacitor 304 is connected across the primary coil 301*a* of the current supply coil 301 by way of the second switching device 302; the primary current in the primary coil 301*a* flows in a path that starts from the positive electrode of the ignition capacitor 304 and returns to the negative electrode of the ignition capacitor 304 by way of the primary coil 301*a*, and the collector and the emitter of the second switching device 302. As the electric-charge amount accumulated in the ignition capacitor 304 becomes larger, the value of the primary current of the current supply coil 301 becomes larger. Accordingly, by appropriately selecting the capacitance value of the ignition capacitor 304 and the charging voltage thereof, a "large current" can be supplied.

The first switching device 104 is switching-controlled based on the control signal Sv from the ECU so as to control the primary current that flows from the power source 100 to the primary coil 102*a* of the high-voltage supply coil 102, so that a predetermined high voltage is generated across the secondary coil 102*b*. The second switching device 302 and the third switching device 305 are switching-controlled based on control signals ScH and ScL, respectively, from the ECU.

The positive electrode of the ignition capacitor 304 is connected with the power source 1001 by way of the rectifier diode 306 and the inductor 303; the negative electrode thereof is connected with the GND by way of the third switching device 305. Accordingly, the ignition capacitor 304 is charged through a path starting from the power source 1001 and reaches the GND by way of the rectifier diode 306, the inductor 303, the positive electrode of the ignition capacitor 304, the negative electrode of the ignition capacitor 304, the collector of the third switching device 305, and the emitter of the switching device 305, in that order.

In the ignition apparatus, configured as described above, according to Embodiment 2 of the present invention, the first switching device 104 and the second switching device 302 are switched by the control signals Sv and ScH, respectively, at the same timings as in foregoing Embodiment 1. The third switching device 305 is switching-controlled by the control signal ScL in such a way to become off when the second switching device 302 is on and to become on when the second switching device 302 is off.

The ignition capacitor 304 is charged from the power source 1001 through the rectifier diode 306 and the inductor 303, when the third switching device 305 is on. At this time, the charging current in the ignition capacitor 304 flows while being amplified at the LC resonance frequency determined by the electrostatic capacitance value C of the ignition capacitor 304 and the inductance value L of the inductor 303. In other words, by appropriately selecting parameters including the inductance value L and the electrostatic capacitance value C, the ignition capacitor 304 can be charged extremely rapidly and with a voltage higher than the voltage of the power source 1001.

The discharging circuit for the ignition capacitor 304 is formed through the primary coil 301*a* of the current supply coil 301 when the second switching device 302 is on; as described above, the electric charges of a charging voltage higher than the voltage value of the power source 1001 are discharged as a large current. As a result, the current supply coil 301 accumulates high magnetic energy.

Next, there will be explained the operation of the ignition apparatus, configured as described above, according to Embodiment 2 of the present invention. In the following explanation, the respective timings correspond to the foregoing timings represented in FIG. 2. In FIG. 3, at first, when at the timing T1, the control signal Sv for controlling the first switching device 104 becomes H-level, the first switching device 104 turns on, and then the primary current I1*v* flows from the power source 100 to the GND by way of the primary coil 102*a* of the high-voltage supply coil 102 and the first switching device 104. Due to the primary current I1*v* that flows in the primary coil 102*a*, the high-voltage supply coil 102 accumulates magnetic energy.

At the timing T2 after sufficient magnetic energy has been accumulated in the high-voltage supply coil 102, the control signal Sv turns to be L-level. As a result, the first switching device 104 turns off, whereby the primary current I1*v* flowing in the high-voltage supply coil 102 is cut off. As a result, the high-voltage supply coil 102 releases the accumulated magnetic energy, so that a secondary voltage, which is a predetermined high voltage, is generated across the secondary coil 102*b*.

The secondary voltage generated across the secondary coil 102*b* of the high-voltage supply coil 102 is applied to the central electrode 101*a* of the ignition plug 101 by way of the secondary coil 301*b* of the current supply coil 301. As a result, at the timing T2, a dielectric breakdown is caused in the plug gap between the central electrode 101*a* and the GND electrode 101*b*, whereby a spark discharge path is formed.

At a time point immediately before the timing T1, the second switching device 302 is off and the third switching device 305 is on; thus, the ignition capacitor 304 is charged from the power source 1001 by way of the rectifier diode 306 and the inductor 303. At this time, the charging current in the ignition capacitor 304 flows while being amplified at the LC resonance frequency determined by the electrostatic capacitance value C of the ignition capacitor 304 and the inductance value L of the inductor 303; the ignition capacitor 304 is charged extremely rapidly and with a voltage higher than the voltage of the power source 1001.

Next, when at the timing T11, the control signal ScH becomes H-level and the control signal ScL becomes L-level, the second switching device 302 turns on and the third switching device 305 turns off, whereby as described above, the discharging circuit for the ignition capacitor 304 is formed through the primary coil 301*a* of the current supply coil 301, and the collector and the emitter of the second switching device 302. As a result, the primary current I1*c*, which is a discharge current of the ignition capacitor 304, flows in the primary coil 301*a* of the current supply coil 301. Here, the timing T11 may be either the same as or different from the timing T1.

When at the timing T11, application of the primary current I1*c* to the primary coil 301*a* of the current supply coil 301 starts, a secondary voltage V2 is induced across the secondary coil 301*b* and the secondary voltage V2 is applied to the central electrode 101*a* of the ignition plug 101; however, because no dielectric breakdown is caused in the plug gap by this level of voltage, no secondary current I2 flows in the plug gap. Due to the primary current I1*c* that starts to flow in the primary coil 301*a* from the timing T11, the current supply coil 301 accumulates magnetic energy.

At the timing T21 after sufficient magnetic energy has been accumulated in the current supply coil 103, the control signal ScH is turned to be L-level and the control signal ScL is turned to be H-level, so that the primary current I1*c* is cut off. Here, it is desirable to set the timing T21 in a time period in which a discharging path is being formed in the plug gap.

At the timing T21, the current supply coil 301 releases the accumulated magnetic energy. As described above, a discharging path has already been formed in the plug gap at the timing T2 and hence the impedance has become extremely small; therefore, when the accumulated large magnetic energy is released through a discharge current of the ignition capacitor 304, the secondary current I2, which is a large induction current, can be made to flow into the discharging path.

When at the timing T21, the switching device 305 turns on, the ignition capacitor 304 is charged from the power source 1001, as described above.

Next, when at the timing T3, the level of the control signal ScH is changed to H level and the level of the control signal ScL is changed to L level, the primary current I1*c* caused by the discharge current of the ignition capacitor 304 starts to flow in the primary coil 301*b* of the current supply coil 301 and hence large magnetic energy is accumulated in the current supply coil 103; concurrently, across the secondary coil 301*a*, there is induced a secondary voltage V2 having a polarity contrary to that thereof at a time when the magnetic energy is released.

At the timing T3, because the discharging path has been formed in the plug gap, the impedance in the plug gap is low; due to a positive voltage generated across the secondary coil 301*b* of the current supply coil 301, a positive-direction discharge current I2, the direction of which is contrary to the direction of the discharge current I2 that has been flowing so far, flows in the plug gap.

Next, when at the timing T4, the level of the control signal ScH is turned to L level and the level of the control signal ScL is turned to H level, the primary current I1*c* of the current supply coil 301 is cut off and hence the current supply coil 301 releases the accumulated energy; thus, a large secondary current I2 having the negative direction flows in the plug gap. After that, by repeating operation similar to the operation from the timing T3 to the timing T4, the secondary current I2 that has the positive direction and the negative direction alternately, i.e., that is an AC large current can be made to flow into the plug gap; therefore, a great deal of plasma can be produced in the plug gap. The ignition apparatus according to Embodiment 2 of the present invention makes it possible to drive the current supply coil at a frequency of as high as 100 [kHz].

In particular, in the case of the CDI method, because the current to be dealt with becomes large, the current may become a noise source to the environment, depending on the product structure or the mounting condition; however, by selecting an operation frequency out of the radio frequency band, the concern that the current may become a noise source can be eliminated.

As described above, in the ignition apparatus according to Embodiment 2 of the present invention, a larger primary current can flow repeatedly in a short time in the primary coil of the current supply coil; therefore, a larger current can be applied to a discharging path of the plug gap. Accordingly, large discharge plasma is formed so that a great deal of plasma can be supplied to the wide area of the combustion chamber so as to facilitate the combustion reaction; therefore, the lean combustion limiting region and the like can be expanded.

Embodiment 3

For example, in an automobile with an internal combustion engine in which gasoline is utilized as a fuel, under some operation conditions, a large-scale exhaust gas recirculation (EGR), ultra-lean combustion, and the like are implemented in order to raise the engine efficiency; however, under other conditions, the engine can sufficiently be operated through a conventional method, i.e., a so-called normal spark discharge.

In an ignition control apparatus according to Embodiment 3 of the present invention is configured in such a way that in foregoing Embodiment 1 or Embodiment 2, the current supply coil is driven only under some operation conditions of the internal combustion engine so as to implement the foregoing operation and that under other, normal operation conditions, the ignition plug causes a spark discharge only with the high-voltage supply coil so as to make the internal combustion engine operate.

Driving of the current supply coil requires large electric power; if the current supply coil is driven under each operation condition, energy required for ignition becomes large; thus, in some cases, it is conceivable that the gasoline mileage is rather deteriorated. Moreover, a large current causes large wear and tear on the electrodes of the ignition plug. Therefore, it is desirable that under conditions other than required ones, driving of the current supply coil is stopped.

The operation conditions that require large plasma are determined, for example, by the ECU. The ECU is an apparatus also for dealing with the foregoing situations, in which large discharge plasma is required, such as implementing large-scale EGR or issuing instruction of use of ultra-lean fuel; therefore, because being capable of promptly perceiving these situations, the ECU is suitable for an apparatus that determines the operation conditions that require large discharge plasma. In this case, the ECU is included in an operation condition determination apparatus that determines the operation condition of the internal combustion engine.

It may be allowed that instead of making the ECU determine the operation condition that requires large discharge plasma, large discharge plasma is produced by driving the current supply coil, when it is determined that the combustion condition of the internal combustion engine is not satisfactory or may become unsatisfactory, based on the output of an inner-cylinder pressure sensor or an ion current sensor of the internal combustion engine, detection of extinction through fluctuation in the rotation speed of the internal combustion engine, or the result of combustion-condition sensing by a vibration sensor or the like. In this case, at least one of the inner-cylinder pressure sensor or the ion current sensor of the internal combustion engine, detection of extinction through fluctuation in the rotation speed of the internal combustion engine, and the vibration sensor or the like is included in the operation condition determination apparatus that determines the operation condition of the internal combustion engine.

Because being capable of applying high energy to ignition, as may be necessary, the ignition apparatus, described above, according to Embodiment 3 of the present invention can contribute to reducing the energy consumed in the internal combustion engine. Moreover, because being capable of preventing unnecessary wear and tear on the ignition plug, the ignition apparatus, described above, according to Embodiment 3 of the present invention can also contribute to preventing the maintenance cost from increasing and natural resources from being wasted.

The ignition apparatus, described above, according to the present invention is mounted in an automobile, a motorcycle, an outboard engine, an extra machine, or the like utilizing an internal combustion engine, and is capable of securely igniting a fuel; therefore, the ignition apparatus makes it possible to effectively operate the internal combustion engine, and hence contributes to the environment preservation and to the solution of the problem of fuel depletion.

Various modifications and alterations of this invention will be apparent to those skilled in the art without departing from the scope and spirit of this invention, and it should be understood that this is not limited to the illustrative embodiments set forth herein.

What is claimed is:

1. An ignition apparatus comprising:

an ignition plug that is provided with a first electrode and a second electrode facing each other through a gap and produces a spark discharge in the gap so that an inflammable fuel-air mixture inside a combustion chamber of an internal combustion engine is ignited;

a first coil device that generates a predetermined high voltage and supplies the generated predetermined high voltage to the first electrode so as to form a path of the spark discharge in the gap; and a second coil device that supplies a current to the spark discharge path formed in the gap, wherein the first coil device includes a primary coil and a secondary coil that are magnetically coupled with each other; the second coil device includes a primary coil and a secondary coil that are magnetically coupled with each other; and the secondary coil of the first coil device supplies the predetermined high voltage to the first electrode of the ignition plug by way of the secondary coil of the second coil device.

2. The ignition apparatus according to claim 1, wherein a primary current that flows in the primary coil of the first coil device is switching-controlled by a first switching device; a primary current that flows in the primary coil of the second coil device is switching-controlled by a second switching device; and the second switching device alternately repeats an off-state and an on-state in a predetermined cycle, after the spark discharge path has been formed.

3. The ignition apparatus according to claim 1, further including a capacitor connected with the primary coil of the second coil device, wherein the primary coil of the second coil device is energized with a primary current based on a discharge current of the capacitor.

4. The ignition apparatus according to claim 3, further including an inductor connected with the capacitor, wherein the capacitor and the inductor configure an LC resonance circuit; and the capacitor is charged based on a resonance phenomenon of the LC resonance circuit.

5. The ignition apparatus according to claim 3, further including a third switching device that controls charging of the capacitor, wherein during ignition operation, the second switching device and the third switching device are controlled in such a way that when one of said switching devices is on, the other one is off and that when the one is off, the other one is on.

6. The ignition apparatus according to claim 1, further including an operation condition determination apparatus that determines a predetermined operation condition of the internal combustion engine, wherein the second coil device is controlled in such a way as to operate only when the operation condition determination apparatus determines that the internal combustion engine is in the predetermined operation condition; and the ignition plug ignites the inflammable fuel-air mixture by means of a spark discharge produced by the first coil device, when the operation of the second coil device is stopped.

7. The ignition apparatus according to claim 6, wherein the operation condition determination apparatus is formed of an engine control unit.

8. The ignition apparatus according to claim 6, wherein the operation condition determination apparatus is formed of at least one of an inner-cylinder pressure sensor of the internal combustion engine, an ion current sensor, detection of extinction through fluctuation in the rotation speed of the internal combustion engine, and a vibration sensor.

9. The ignition apparatus according to claim 1, wherein a resistance value of the current path of the ignition plug, excluding a resistance value of the gap, is 300[Ω] or smaller.

* * * * *